US007508133B2

(12) United States Patent
Hara

(10) Patent No.: US 7,508,133 B2
(45) Date of Patent: Mar. 24, 2009

(54) DISCHARGE LAMP AND ILLUMINATION APPARATUS WITH GAS FILL

(75) Inventor: Yukio Hara, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 11/385,602

(22) Filed: Mar. 21, 2006

(65) Prior Publication Data

US 2006/0214581 A1 Sep. 28, 2006

(30) Foreign Application Priority Data

Mar. 24, 2005 (JP) ..... 2005-087101

(51) Int. Cl.
*H01J 17/20* (2006.01)
*H01J 17/00* (2006.01)
*H01J 61/20* (2006.01)

(52) U.S. Cl. ..... 313/568; 313/567; 313/642; 313/483; 313/484

(58) Field of Classification Search ..... 313/567–568, 313/572, 591, 483–484, 637–643
See application file for complete search history.

(56) References Cited

U.S. PATENT DOCUMENTS 4,882,520 A * 11/1989 Tsunekawa et al. ..... 313/643
4,914,347 A * 4/1990 Osawa et al. ..... 313/485
5,103,133 A * 4/1992 Misono ..... 313/491
5,278,474 A * 1/1994 Nieda ..... 313/631
5,907,222 A * 5/1999 Lengyel et al. ..... 315/158
5,962,977 A * 10/1999 Matsumoto et al. ..... 313/633
2002/0185979 A1* 12/2002 Jackson et al. ..... 313/642
2003/0218415 A1* 11/2003 Matsuo ..... 313/485
2006/0139934 A1* 6/2006 Hirohashi et al. ..... 362/362

* cited by examiner

*Primary Examiner*—Nimeshkumar D Patel
*Assistant Examiner*—Anne M Hines
(74) *Attorney, Agent, or Firm*—Wolf, Greenfield & Sacks, P.C.

(57) ABSTRACT

A discharge lamp includes a glass tube having electrodes with an electron emissive material coated thereon, the electrodes being provided on respective ends of the glass tube, wherein the glass tube has a gas containing a luminescent material sealed therein and has a fluorescent material coated on its inner surface, the glass tube has a diameter less than 6.5 mm and the gas sealed into the glass tube is gases of more than one kind selected from an Ar (argon) gas , a Kr (krypton) gas and a Xe (xenon) gas or a mixed gas mainly made of gases of more than one kind selected from the Ar gas, the Kr gas and the Xe gas. Thus, the discharge lamp can reduce a diameter of its tube and it is able to provide high luminous efficiency.

5 Claims, 2 Drawing Sheets

DISCHARGE LAMP AND ILLUMINATION APPARATUS WITH GAS FILL

CROSS REFERENCES TO RELATED APPLICATIONS

The present invention contains subject matter related to Japanese Patent Application JP 2005-087101 filed in the Japanese Patent Office on Mar. 24, 2005, the entire contents of which being incorporated herein by reference.

BACKGROUND OF THE INVENTION

1. Field of the Invention

The present invention relates to a discharge lamp such as a hot cathode type discharge lamp and an illumination apparatus including a discharge lamp.

2. Description of the Related Art

It has been customary to use a discharge lamp using a fluorescent substance as a light source.

As a discharge lamp using a fluorescent substance, there are enumerated a hot cathode type discharge lamp and a cold cathode type discharge lamp.

A hot cathode type discharge lamp has an arrangement in which electrodes having a filament or a coil are provided at respective end portions of a glass tube, a gas such as argon gas and mercury being occluded in the space within the glass tube and a fluorescent substance being coated on the inner surface of the glass tube (see Cited Patent Reference 1, for example).

A cold cathode type discharge lamp has an arrangement in which electrodes are provided at respective end portions of a glass tube, a gas such as argon gas and mercury being occluded into a space within the glass tube, a fluorescent substance being coated on the inner surface of the glass tube. The cold cathode type discharge lamp has no filament or coil provided on the electrodes.

In particular, since the hot cathode type discharge lamp is high in luminous efficiency and brightness, it is used as an illumination apparatus and it is also applied to a backlight of a liquid-crystal display.

[Cited Patent Reference 1]: Official Gazette of Japanese laid-open patent application No. 5-251042

However, since the related-art hot cathode type discharge lamp is as large as about 20 mm in diameter, it is not suitable for the application as a backlight of a liquid-crystal display of a small device.

On the other hand, since the cold cathode type discharge lamp is large in voltage drop in the cathode, its luminous efficiency is lowered unavoidably.

Accordingly, it is desirable that the diameter of the discharge lamp should be decreased and that its luminous efficiency should be increased.

SUMMARY OF THE INVENTION

In view of the aforesaid aspects, the present invention intends to provide a discharge lamp with a diameter thereof being decreased and which can obtain high luminous efficiency.

Also, the present invention intends to provide an illumination apparatus including this discharge lamp.

According to an aspect of the present invention, there is provided a discharge lamp which is comprised of a glass tube having electrodes with an electron emissive material coated thereon, the electrodes being provided on respective ends of the glass tube, wherein the glass tube has a gas containing a luminescent material sealed therein and has a fluorescent material coated on its inner surface, the glass tube has a diameter less than 6.5 mm and the gas sealed into the glass tube is gases of more than one kind selected from an Ar (argon) gas, a Kr (krypton) gas and a Xe (xenon) gas or a mixed gas mainly made of gases of more than one kind selected from the Ar gas, the Kr gas and the Xe gas.

In accordance with another aspect of the present invention, there is provided an illumination apparatus which is comprised of a discharge tube, the discharge tube being composed of a glass tube having electrodes with an electron emissive material coated thereon, the electrodes being provided on respective ends of the glass tube, wherein the glass tube has a gas containing a luminescent material sealed therein and has a fluorescent material coated on its inner surface, the glass tube has a diameter less than 6.5 mm and the gas sealed into the glass tube is gases of more than one kind selected from an Ar (argon) gas, a Kr (krypton) gas and a Xe (xenon) gas or a mixed gas mainly made of gases of more than one kind selected from the Ar gas, the Kr gas and the Xe gas.

According to the above-mentioned arrangement of the present invention, since the gas sealed into the glass tube is gases of more than one kind selected from the Ar gas, the Kr gas and the Xe gas or a mixed gas mainly made of gases of more than one kind selected from the Ar gas, the Kr gas and the Xe gas, the Ar gas, the Kr gas and the Xe gas have thermal conductivity smaller than that of a Ne gas for use with a cold cathode type discharge lamp and the like. As a result, a loss caused by thermal conduction can be suppressed and luminous efficiency can be improved.

Then, since the glass tube has a diameter less than 6.5 mm, it is possible to construct a thin discharge lamp.

According to the above-mentioned discharge lamp of the present invention, since luminous efficiency of the discharge lamp can be improved, power consumption can be decreased and brightness can be increased.

Also, the diameter of the discharge lamp can be decreased.

Further, since an illumination apparatus (for example, a backlight apparatus of a liquid-crystal display) including a discharge lamp according to the present invention can decrease power consumption of the discharge lamp, it is possible to decrease power consumption of the illumination apparatus.

DESCRIPTION OF THE PREFERRED EMBODIMENTS

The present invention will now be described in detail with reference to the drawings.

Figure 1:
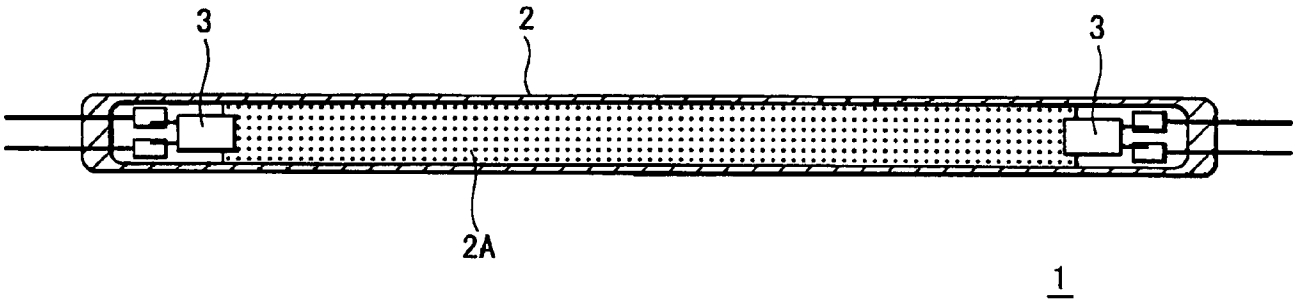
FIG. 1 is a schematic diagram showing an arrangement of a discharge lamp according to an embodiment of the present invention.

FIG. 1 of the accompanying drawings is a schematic diagram showing an arrangement of a discharge lamp according to an embodiment of the present invention.

A discharge lamp, generally depicted by reference numeral 1 in FIG. 1, includes a long and narrow glass tube 2 with electrodes 3 attached to its respective end portions, and two lead wires (lead-in wires) are connected to the two electrodes 3.

As shown in FIG. 1, a fluorescent substance layer 2A (also see FIG. 2) is formed on the inner surface of the glass tube 2.

Also, the glass tube 2 has a rare gas such as argon (Ar) gas and mercury (Hg) serving as a luminescent material sealed into the inside thereof.

Figure 2:
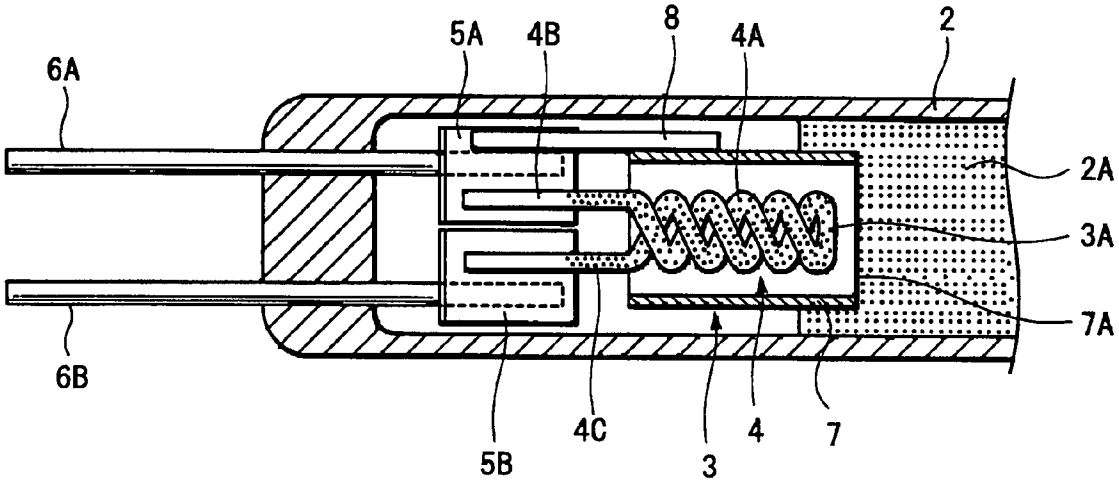
FIG. 2 is a diagram showing components provided near an electrode at the left end portion of the discharge lamp shown in FIG. 1 in an enlarged-scale.

FIG. 2 is a diagram showing components provided near the electrode 3 at the left end portion of the discharge lamp 1 shown in FIG. 1 in an enlarged-scale;

As shown in FIG. 2, the electrode 3 includes a heater 4 composed of a coil portion 4A and a first lead portion 4B and a second lead portion 4C, both of which is connected to the coil portion 4A. The heater 4 is made of wire material such as tungsten (W) or rhenium tungsten (Re—W).

The heater 4 includes the coil portion 4A of a substantially cylindrical shape which is obtained by winding spiral windings of wire material in a double or triple spiral shape so that the wire materials may not be contacted with each other. Further, the two lead portions 4B and 4C are extended from the rear end of the coil portion 4A.

Also, the heater 4 is covered with an electron emissive material 3A, for example, ternary alkali earth metal oxide made of barium (Ba), strontium (Sr) and calcium (Ca).

The electron emissive material is not limited to the above-mentioned ternary alkali earth metal oxide, and other materials such as binary barium oxide may be used as the electron emissive material.

Since the heater 4 has the double or triple spiral structure, the long wire material becomes necessary to form the coil portion 4A so that the surface area of the coil portion 4A can be increased. Accordingly, the quantity of the electron emissive material coated on the coil portion 4A can be increased, which can prolong the life of the electrode 3.

A wire material having a diameter ranging of from approximately 25 μm to 70 μm is available as the wire material to form the heater 4. It is desirable that the wire material should have a diameter ranging of from approximately 45 μm to 55μ, for example, so that the wire material may become easy to wind when the heater 4 has the double spiral structure and that sufficient strength may be maintained.

As shown in FIG. 2, the electrode 3 is provided with a first heater tab 5A and a second heater tab 5B to support the heater 4. The rear end side of the first lead portion 4B of the heater 4 is joined to the first heater tab 5A by welding, and the rear end side of the second lead portion 4C of the heater 4 is joined to the second heater tab 5B by welding.

The first and second heater tabs 5A and 5B may be made of a plate material such as a stainless steel (SUS304).

The electrode 3 is connected through the first heater tab 5A and the second heater tab 5B to lead wires (lead-in wires) 6A and 6B. The lead wires (lead-in wires) 6A and 6B are substantially parallel to each other and they are passed through the end portion of the glass tube 2 from the outside to the inside.

The first heater tab 5A is joined to the first lead-in wire 6A at its tip end side of the portion extended into the inside of the glass tube 2 by welding. The second heater tab 5B is joined to the second lead-in wire 6B at its tip end side of the portion extended into the inside of the glass tube by welding.

As described above, the electrode 3 supported with the leader wires (lead-in wires) 6A and 6B has a vertical arrangement in which the coil portion 4A of the heater 4 may be extended along tube axis of the glass tube 2. As a result, ions produced by discharging are mainly bombarded against the tip end of the coil 4A so that the electron emissive material 3A is difficult to scatter on the side surface of the coil 4A due to bombardment of ions.

Also, since the electrode 3 supports the heater 4 to the lead-in wires 6A and 6B by the two lead portions 4B and 4C extended from the rear end side of the coil portion 4A, no tension is applied to the heater 4 and hence breaking of wire is difficult to occur.

Further, as shown in FIG. 2, the electrode 3 is provided with a sleeve 7 to prevent the electron emissive material 3A from being scattered and evaporated. The sleeve 7 is an example of a scattering preventing member. The sleeve 7 is made of a suitable material such as nickel (Ni) and molybdenum (Mo) and it is shaped like a cylinder of which respective ends are opened.

The sleeve 7 is inserted into the inside of the heater 4 in such a manner that the coil portion 4A of the heater 4 may become substantially parallel to the sleeve 7. Then, the sleeve 7 is attached to the first heater tab 5A by a sleeve lead 8, whereby the sleeve 7 covers the circumference of the coil portion 4A in the state in which the tip end side and the rear end side of the coil portion 4A are opened.

The sleeve lead 8 is made of a stainless steel (SUS304) similarly to the first and second heater tabs 5A and 5B. Also, the sleeve lead 8 may be secured to the second heater tab 5B.

The inner diameter of the sleeve 7 is larger than the outer diameter of the coil portion 4A of the heater 4 so that the coil portion 4A may be prevented from contacting with the sleeve 7 when the coil portion 4A of the heater 4 is inserted into the inside of the sleeve 7 in the direction in which the coil portion 4A of the heater 4 becomes substantially parallel to the sleeve 7.

Also, the outer diameter of the sleeve 7 is made smaller than the inner diameter of the glass tube 3 so that the sleeve 7 and the glass tube 2 may be prevented from contacting with each other.

Further, the sleeve 7 is attached to the heater 4 in such a positional relationship that the tip end portion of the coil portion 4A may not be projected from an open end face 7A of the sleeve 7. While the sleeve 7 and the heater 4 should preferably be set to such a positional relationship that the tip end portion of the coil portion 4A may lie in the inside of the open end face 7A of the sleeve 7, it is also possible that the open end face 7A of the sleeve 7 and the tip end portion of the coil portion 4A may become flush with each other.

Also, the sleeve 7 is longer than the coil portion 4A and the whole of the side surface of the coil portion 4A is covered with the sleeve 7.

A coated range of the fluorescent substance layer 2A on the inner surface of the glass tube 2 is limited up to the position that is slightly outside of the open end face 7A of the sleeve 7 of the electrode 3. This coated range of the fluorescent substance layer 2A becomes a light-emitting portion of the discharge lamp 1.

In the discharge lamp 1 according to this embodiment, in particular, a gas sealed into the inside of the glass tube 2 may be gases of more than one kind selected from an Ar (argon) gas, a Kr (krypton) gas and a Xe (xenon) gas or it may be a mixed gas which is mainly made of gases of more than one kind selected from the Ar gas, the Kr gas and the Xe gas.

Thus, since the Ar gas, the Kr gas and the Xe gas are gases having relatively small thermal conductivity, a loss caused by thermal conduction can be decreased and hence luminous efficiency can be improved.

Further, a total pressure of a gas sealed into the glass tube 2 should more preferably be selected so as to fall within a range of from 10 60 Torr.

If the total pressure of the gas is selected within the above-mentioned range, then it is possible to especially improve the luminous efficiency of the discharge lamp 1.

Then, since the above-described pressure range is higher than a gas pressure (less than 10 Torr and approximately in a range of from 3 to 8 Torr) of a hot cathode tube which is generally used, ion bombardment on the electrode by ions of the sealed gas can be decreased and hence the life span of the discharge lamp 1 can be prolonged.

Also, in the discharge lamp 1 according to this embodiment, the diameter of the glass tube 2 is uniform and the diameter of the glass tube 2 is selected to be less than 6.5 mm.

As a consequence, the glass tube 2 has no exhaust pipe provided at its end portion and therefore it is possible to decrease the diameter of the glass tube 2. Also, it is possible to decrease an ineffective light emission length of the discharge lamp 1.

Then, since the diameter of the glass tube 2 is less than 6.5 mm, it is possible to construct the thin discharge lamp 1.

More preferably, the diameter of the glass tube 2 should be made as thin as about 2 mm to 3 mm.

When the sealed gas is a mixed gas containing a Ne gas, it is desirable that a ratio of the Ne gas in the mixed gas should be selected to be less than 50%.

The reason for this is that, since the Ne gas is relatively large in thermal conductivity, if the content of the Ne gas in the mixed gas is large, then a loss is so increased that it is not possible to sufficiently increase luminous efficiency.

Next, operations of the discharge lamp 1 according to this embodiment will be described.

First, a voltage of about 5V, for example, is applied to the respective electrodes 3 to enable the heater 4 to heat the electron emissive material 3A. Then, a voltage of 600V, for example, is applied to the two electrodes 3 and 3 at a high frequency through the lead wires (lead-in wires) 6A and 6B. As a result, electrons are emitted from the electron emissive material 3A to cause glow discharge to occur between the two electrodes 3 and 3.

After the glow discharge occurred between the two electrodes 3 and 3, a voltage of about 300V, for example, is applied to the two electrodes 3 and 3 and a voltage of about 3V, for example, is applied to the two electrodes 3 and 3 under control. At that time, discharging is maintained at a tube electric current ranging of from 5 to 30 mA, for example, 10 mA.

Electrons accelerated after they were emitted from the electron emissive material 3A strike mercury electrons to excite mercury electrons. The thus excited mercury electrons emit ultraviolet ray and this ultraviolet ray is converted into visible light by the fluorescent material of the fluorescent material layer 2A to thereby energize the discharge lamp 1 to emit light.

Although ions generated during discharging strike the electrodes 3 and 3 to cause the electron emissive material 3A to scatter, since the coil portion 4A is disposed in the longitudinal direction extending along the tube axis of the glass tube 2, ions mainly strike the tip end portion of the coil portion 4A. As a result, scattering of the electron emissive material 3A may be suppressed at most of the side surface of the coil portion 4A.

Also, since the coil portion 7A is inserted into the sleeve 7 and the open end face of the sleeve 7 is projected from the tip end portion of the coil portion 4A, ion bombardment on the tip end portion of the coil portion 4A can be decreased. As a result, exhaustion of the electron emissive material can be suppressed for a long period of time.

Accordingly, since the electrode 3 can emit electrons for a long period of time, the life span of the electrode 3 can be prolonged.

Further, when the discharge lamp 1 is not provided with the sleeve 7, the evaporated electron emissive material may be vapor-deposited on the inner surface of the glass tube 2.

On the other hand, according to the embodiment of the present invention, since the coil portion 4A is inserted into the sleeve 7, the electron emissive material evaporated from the heater 4 is vapor-deposited on the inner surface of the sleeve 7. Then, when the heater 4 is energized, the sleeve 7 also is heated to cause electrons to be emitted from the electron emissive material deposited on the inner surface of the sleeve 7. As a consequence, it is possible to prolong the life span of the electrode 3.

Because the life span of the electrode 3 can be prolonged as described above, it is possible to prolong the life span of the discharge lamp 1.

Also, since the heater 4 is inserted into the sleeve 7, the heater 4 can be heated up to a desired temperature at a low voltage by thermal radiation. For example, it is possible to lower a voltage, which is applied in order to preheat the heater 4, from approximately 5V to approximately 3V.

It is known that, when the kind or pressure of the sealed gas is changed, an electric potential gradient of a positive column is changed so that a tube voltage also is changed.

This change differs depending on the kind of the sealed gas. For example, it was to be understood that, if the pressure of a gas having excellent heat conductivity such as a He (helium) gas and a Ne (neon) gas is increased, then power consumption required to keep a heater at a constant temperature is increased.

This leads to the increase of power consumption of the discharge lamp, which causes luminous efficiency of the discharge lamp to be deteriorated unavoidably.

A relationship between the temperature of the heater and electric power consumed by the heater was examined while the pressure of the sealed gas and the kind of the sealed gas were varied.

With respect to the change of the pressure of the sealed gas, in the state in which an Ar (argon) gas was used and in which the pressure of the sealed Ar gas was selected to be 25 Torr, 60 Torr and 90 Torr, relationships between the temperature of the heater and the electric power were measured.

In the state in which the Ne (neon) gas, the Kr (krypton) gas and the Xe (xenon) gas were used as the kind of gas and in which the pressures of these gases were respectively selected to be 90 Torr, relationships between the temperature of the heater and electric power were measured.

Also, relationship between the temperature of heater and electric power in vacuum also were measured as comparisons.

Figure 3:
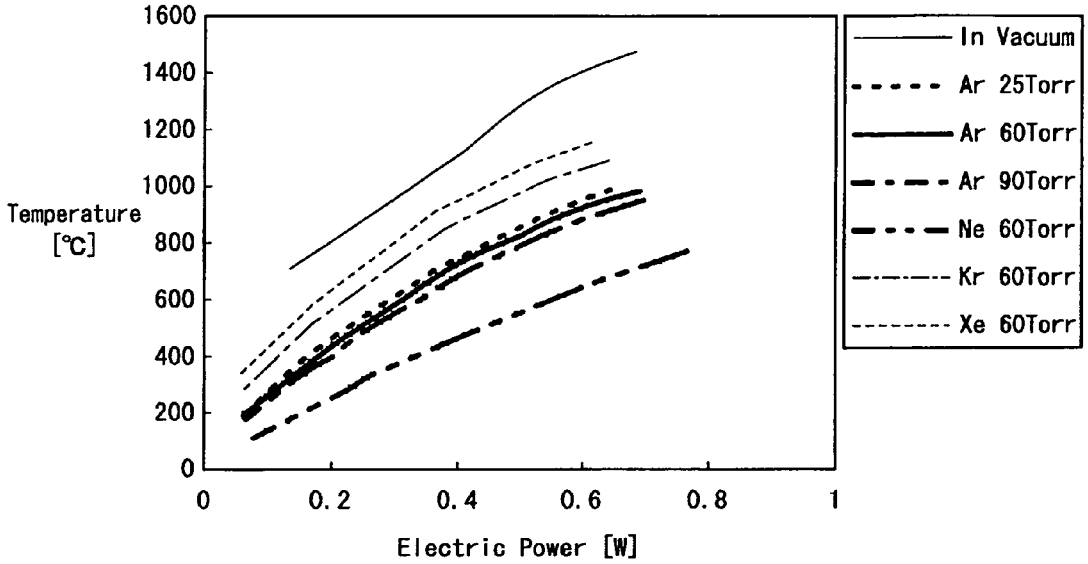
FIG. 3 is a diagram showing characteristic curves obtained when pressure of gas sealed into a discharge lamp and the kind of a gas were changed and to which reference will be made in explaining a relationship between a temperature of a heater and electric power consumed by the heater.

FIG. 3 shows measured results.

A study of FIG. 3 reveals that, when the pressure of the sealed gas is increased, thermal conductivity of the sealed gas and the heater is increased so that power consumption is increased, thereby resulting in luminous efficiency being deteriorated.

Also, it is clear from the measured results of FIG. 3 that, although power consumption is increased when the Ne (neon) gas is used as the sealed gas, power consumption required when the Ar (argon) gas, the Kr (krypton) gas and the Xe (xenon) gas are used as the sealed gas can become smaller than that required when the Ne gas is used as the sealed gas.

Next, relationships between the pressure of the sealed gas and the luminous efficiency were examined while the kind of the sealed gases and the mixed ratio of the sealed gases were changed.

While the kind of the sealed gas and the mixed ratios of the sealed gases were selected such that Ar 100%, Ar 50%-Ne 50%, Ar 5%-Ne 95%, Kr 50%-Ne 50% and Xe 50%-Ne 50% might be established, relationships between the pressures of the sealed gases and the luminous efficiency were measured.

Figure 4:
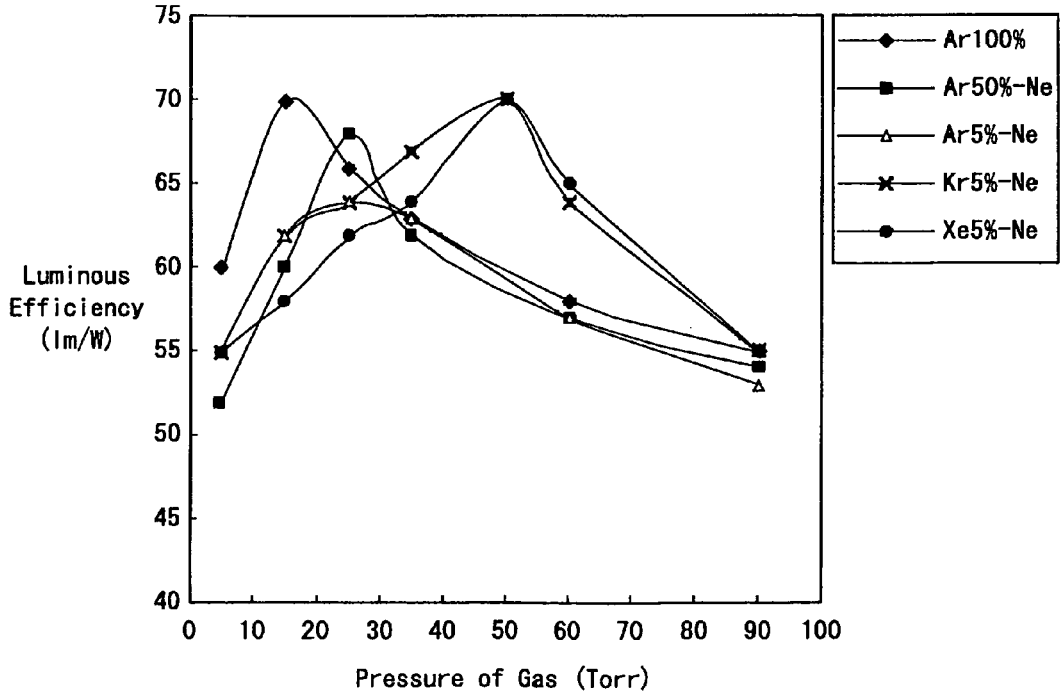
FIG. 4 is a diagram showing characteristic curves obtained when the kind of gas sealed into the discharge lamp and a mixing ratio of gases were changed and to which reference will be made in explaining a relationship between pressure of a gas sealed into the discharge lamp and electric power consumed by the heater.

FIG. 4 shows measured results. Luminous efficiency on the vertical axis is 1 m/W.

Luminous efficiency of the cold cathode type discharge lamp, which is generally used as the application to a backlight, may fall within a range of from approximately 50 to 55 [1 m/W].

A study of FIG. 4 reveals that, when the Ar gas was used mainly and the mixed ratio of the Ar gas was varied, the maximum value of luminous efficiency is increased as the mixed ratio of the Ar gas was increased.

There is a tendency in which the gas pressure required when the luminous efficiency becomes the maximum may be shifted to the high pressure side as the mixed ratio of the Ar gas was varied.

Also, when the kind of gas is changed, while the luminous efficiency of the Ar gas is relatively high on the low pressure side, luminous efficiency of the Kr gas and the Xe gas is relatively high on the high pressure side.

Further, it is to be understood that, when the gas pressure is selected in a range of from 10 to 60 Torr, if any gas is used, then luminous efficiency higher than 55 [1 m/W] can be obtained so that luminous efficiency can be increased.

<INVENTIVE EXAMPLE>

Next, the discharge lamp 1 having the arrangement shown in FIGS. 1 and 2 was manufactured in actual practice and characteristics of the above discharge lamp 1 were measured.

The diameter of the glass tube 2 was selected to be 2 mm, the gas sealed into the glass tube 2 was selected to be a mixed gas of Ar 95%-Ne 5%, the pressure of the gas sealed into the glass tube 2 was selected to be 20 Torr and the discharge lamp 1 was manufactured.

Next, the discharge lamp 1 of this inventive example was mounted on a 10.6-inch edge light type liquid-crystal display backlight and power consumption of this edge light type liquid-crystal display backlight and power consumption of a backlight having a cold cathode type discharge lamp mounted thereon were measured.

From measured results, it became clear that power consumption of the discharge lamp 1 of this inventive example was decreased to 2.43 W as compared with the cold cathode type discharge lamp having power consumption of 3.36 W and that power consumption of the backlight also was decreased by approximately 35% from 4.5 W to 3.0 W.

As described above, the discharge lamp according to the present invention can decrease power consumption. Also, according to the discharge lamp of the present invention, it is possible to increase luminous efficiency of an illumination apparatus (for example, a backlight apparatus of a liquid-crystal display) including the discharge lamp to thereby improve brightness of the illumination apparatus.

Also, if the cold cathode type discharge lamp for use with the backlight is used as the electric current is increased more from 6 mA, then its life span will be shortened unavoidably. Whereas, the discharge lamp according to the present invention is in use, this discharge lamp can be used until the electric current is increased up to about 30 mA so that the life span of this discharge lamp also can be prolonged.

While the electrode 3 has the heater 4 and the sleeve 7 shown in FIG. 2 in the above-mentioned embodiment, the fluorescent tube according to the present invention is not limited to the arrangement shown in FIG. 2 and it can adopt various arrangements.

According to the above-mentioned discharge lamp of the present invention, since luminous efficiency of the discharge lamp can be improved, power consumption can be decreased and brightness can be increased.

Also, the diameter of the discharge lamp can be decreased.

Further, since an illumination apparatus (for example, a backlight apparatus of a liquid-crystal display) including a discharge lamp according to the present invention can decrease power consumption of the discharge lamp, it is possible to decrease power consumption of the illumination apparatus.

It should be understood by those skilled in the art that various modifications, combinations, sub-combinations and alterations may occur depending on design requirements and other factors insofar as they are within the scope of the appended claims or the equivalents thereof.

What is claimed is:

1. A hot-cathode type discharge lamp comprising:

a glass tube having two electrodes with an electron emissive material coated thereon, each electrode including a heater composed of a filament or coil, said electrodes being provided in respective ends of said glass tube, wherein:

said glass tube has a gas containing a luminescent material sealed therein, the luminescent material including mercury, said glass tube further includes a fluorescent material coated on its inner surface, said glass tube has a diameter less than 6.5 mm, said gas sealed into said glass tube is comprised of gases of more than one kind selected from an Ar (argon) gas, a Kr (krypton) gas and a Xe (xenon) gas, and including less than 50% of a Ne (neon) gas, and said sealed gas has a total pressure ranging from 10 to 60 Torr.

2. The hot-cathode type discharge lamp of claim 1, wherein the glass tube has a diameter less 3 mm.

3. The hot-cathode type discharge lamp of claim 1, wherein a power consumption of the lamp is less than 3 W.

4. An illumination apparatus comprising:

a hot-cathode type discharge lamp, said discharge lamp being composed of:

a glass tube having two electrodes with an electron emissive material coated thereon, each electrode including a heater composed of a filament or coil, said electrodes being provided in respective ends of said glass tube, wherein:

said glass tube has a gas containing a luminescent material sealed therein, the luminescent material including mercury, said glass tube further includes a fluorescent material coated on its inner surface, said glass tube has a diameter less than 6.5 mm, said gas sealed into said glass tube is comprised of gases of more than one kind selected from an Ar (argon) gas, a Kr (krypton) gas and a Xe (xenon) gas, and including less than 50% of a Ne (neon) gas, and said sealed gas has a total pressure ranging from 10 to 60 Torr.

5. An apparatus comprising:

a hot-cathode type discharge lamp, said discharge lamp being composed of:

a glass tube having two electrodes with an electron emissive material coated thereon, each electrode including a heater composed of a filament or coil, said electrodes being provided in respective ends of said glass tube, wherein:

said glass tube has a gas containing a luminescent material sealed therein, the luminescent material including mercury, said glass tube further includes a fluorescent material coated on its inner surface, said glass tube has a diameter less than 6.5 mm, said gas sealed into said glass tube is comprised of gases of more than one kind selected from an Ar (argon) gas, a Kr (krypton) gas, and a Xe (xenon) gas, and including less than 50% of a Ne (neon) gas, and said sealed gas has a total pressure ranging from 10 to 60 Torr.

* * * * *